US005790028A

United States Patent [19]

Lee

[11] Patent Number: 5,790,028

[45] Date of Patent: Aug. 4, 1998

[54] INNOVATED ANTI-ROBBERY HANDBAG/BOX

[76] Inventor: Chun-Hui Lee, 6, Lane 99, Chang-Chi Street, Taipei, Taiwan

[21] Appl. No.: 966,754

[22] Filed: Nov. 10, 1997

[51] Int. Cl.[6] ..... G08B 13/14; G08B 13/00; G08B 1/08

[52] U.S. Cl. ..... 340/571; 340/539; 340/574

[58] Field of Search ..... 340/539, 541, 340/571, 572, 573, 574

[56] References Cited

U.S. PATENT DOCUMENTS

| | | | |
|---|---|---|---|
| 4,591,835 | 5/1986 | Sharp | 340/574 |
| 4,804,943 | 2/1989 | Soleimani | 340/539 |
| 4,908,606 | 3/1990 | Kevonian | 340/571 |
| 5,001,460 | 3/1991 | Basson | 340/571 |
| 5,043,702 | 8/1991 | Kuo | 340/539 |
| 5,126,719 | 6/1992 | DeSorbo | 340/571 |

*Primary Examiner*—Brent A. Swarthout
*Assistant Examiner*—Van T. Treiu
*Attorney, Agent, or Firm*—Jacobson, Price, Holman & Stern, PLLC

[57] ABSTRACT

The present invention relates to an innovated anti-robbery handbag/box, having wires that are spaced onto the interior of the bag/box or container; each wire being connected with the high voltage discharge unit; in the master control box are a central processing device and other components; the master control box may be placed on the bottom of the bag/box; the central processing device comprises a central processing unit in a circuit board; the central processing device is respectively connected to the battery set, the security pull pin, the discharge unit, the buzzer, the chemical pouch, the radio frequency signal receiver and the timer; so designed that when the security pull pin starts the activation, it will discharge high voltage current onto the bag/box, and the buzzer will start to sound, and the chemical pouch will spray smoke onto the money notes inside the bag/box, to execute a longer period of discharge followed by a minimum period of current interruption, to allow the switching-off signal from the remote control unit to penetrate through the interval to switch off current.

1 Claim, 7 Drawing Sheets

INNOVATED ANTI-ROBBERY HANDBAG/BOX

BACKGROUND OF THE INVENTION

The present invention relates to an innovated anti-robbery handbag/box, particularly to one that involves the functions of electrical shock, sounding, smoking, and dying on paper money.

DESCRIPTION OF PRIOR ART

Conventionally, a prior art of anti-robbery handbag or tote box is usually provided with the components such as a power source battery, a power switch, an indicator lamp, a R.F. signal receiver circuit, a printed circuit board, a buzzer, a buzzer switch, a high voltage generator, a transfer switch, etc. are all connected to become an anti-robbery circuit, and accommodated inside a box body; the box body is placed and secured on the bottom plate in a handbag; the two sides of the bottom plate are printed with circuits of alternating positive and negative current; the circuits are connected with the output terminals of the high voltage generator. On the inside wall of the handbag are disposed the naked electrical wires that are spaced in an interval of 2 cm to 5 cm in circular distribution; the naked wires are connected with the connectors on the bottom plate; so that a high voltage current of 40 KV output by the high voltage generator may be distributed around the handbag; so designed that in case the handbag is robbed, the control unit will send off signals to control alarm sound and high voltage current for the purpose of anti-robbery. In such a mechanism that is operated by a remote control unit within a distance of 100 meters, there are the following weaknesses:

1. In case the radio signal is interfered or obstructed by metal objects, the main unit will not be able to receive the starting signal, and the unit will fail to discharge high voltage current or sound the buzzer.
2. If a normal remote control unit is used, the start key on the remote control unit will easily be touched by mistake, then the starting signal will start the alarm unit and stun the generator to attack the cash carrier.
3. In case the frequency and code of another remote control device happen to be consistent with this system, the other user may accidentally send out a signal to start this system and attack the cash carrier.
4. In case the robber wears rubber gloves, then, even if the handbag/tote case discharges high voltage current, it will cause no harm.
5. When the main unit starts the discharge system, the whole bag is inside an electric field; in such a case, if the cash carrier wishes to switch off the system, he may have trouble sending his switching-off signal into the bag, so the main unit could not be switched off.

The prior art adopts a battery power source to generate high voltage current, to produce the electric shock; when activated, the bag/box forms a high intensity electrical field that will obstruct the entrance of any signals; so, in case the cash carrier was attacked by the electrical shock by mistake, sometimes there is no way that the unit can be switched off at the initial time to save the cash carrier.

Therefore, the subject inventor has developed and designed the present invention.

SUMMARY OF THE INVENTION

The primary purpose of the present invention is to provide an anti-robbery handbag/box, involving conductive wires that are arranged on the surrounding walls of the handbag/box, but on the circuit board is the addition of the micro-processing unit to achieve the effect of programmable control, including the following improvement points;

1. The master control box in the bag is activated by a security pull pin; the security pull pin is linked with a chain to the body of the cash carrier; so designed that the relevant devices will be activated until a period of preset time has elapsed after the security pull pin is pulled out; on the remote control unit is another security pull pin that is used for direct activation of the switch. By software arrangement it enables the master control box to send out buzzer sound before the high voltage current is discharged, thus enhancing the safety of the cash carrier in case the alarm unit is activated by mistake. Furthermore, it serves to reduce the risk of being accidentally activated by another remote control unit.
2. In the control box is another chemical pouch and/or tear gas, so that when the master control box is activated, it will, at the same time or after a while, detonate the chemical pouches containing the tear gas and the coloring dyes; even if the robber is wearing rubber gloves, he will be frightened by the additional effects; and, after the paper money is dyed in colors, the money can be traced and identified easily.
3. In a prior art, the unit may not be switched off once it is activated. In the master control box of the present invention, there is a central processing unit (CPU) that will control the discharge function to include discharging and interruption at "long-and-short" intervals, so that the signal from the remote control may penetrate the electrical field to execute the switching-off function during the short intervals.

To enable better understanding of the integral configuration, devices, characteristics and functions of the present invention, the embodiment of the present invention is described in details with drawings:

DETAILED DESCRIPTION OF PREFERRED EMBODIMENT

Figure 1:
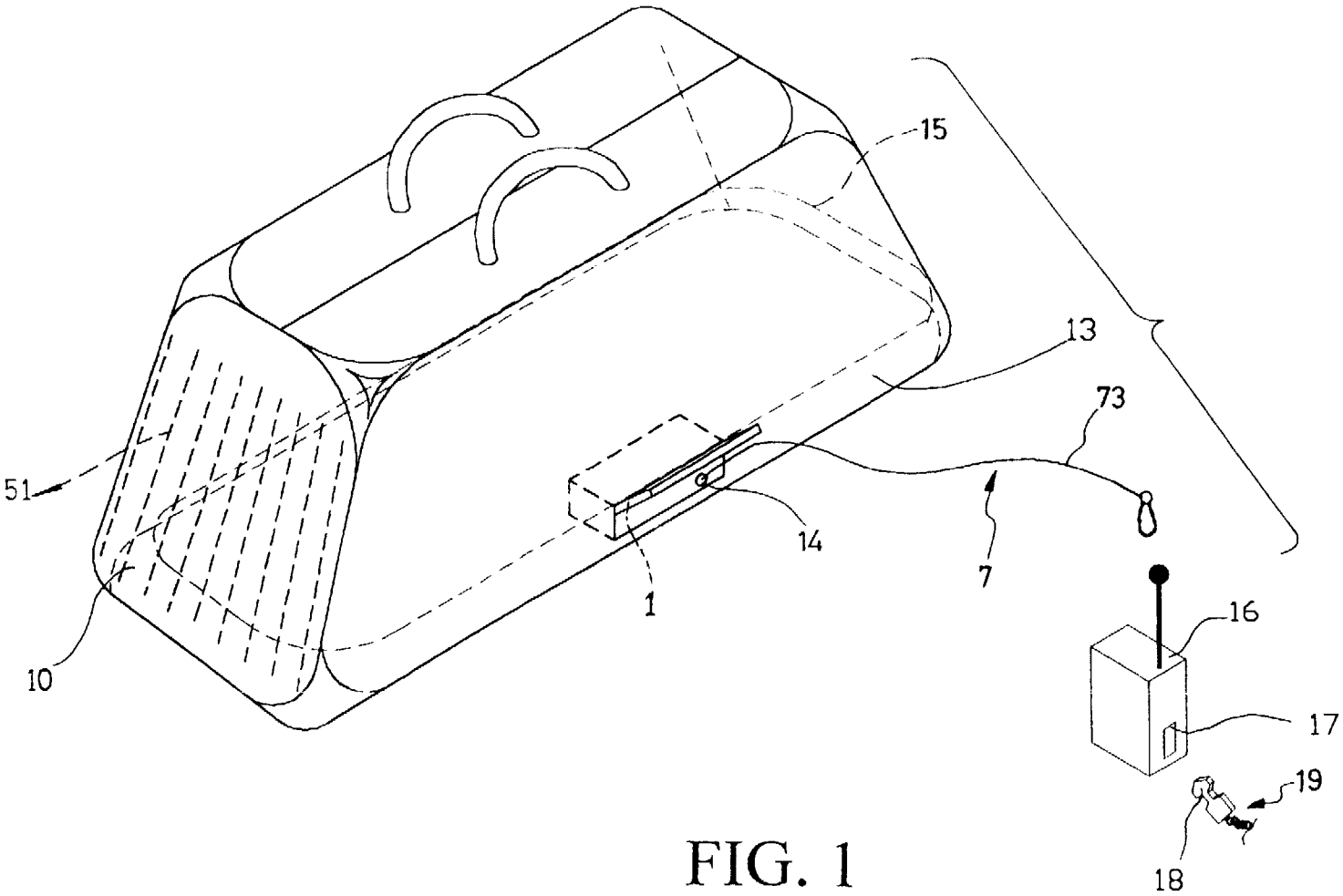
FIG. 1 is a perspective view of the present invention.
Figure 2:
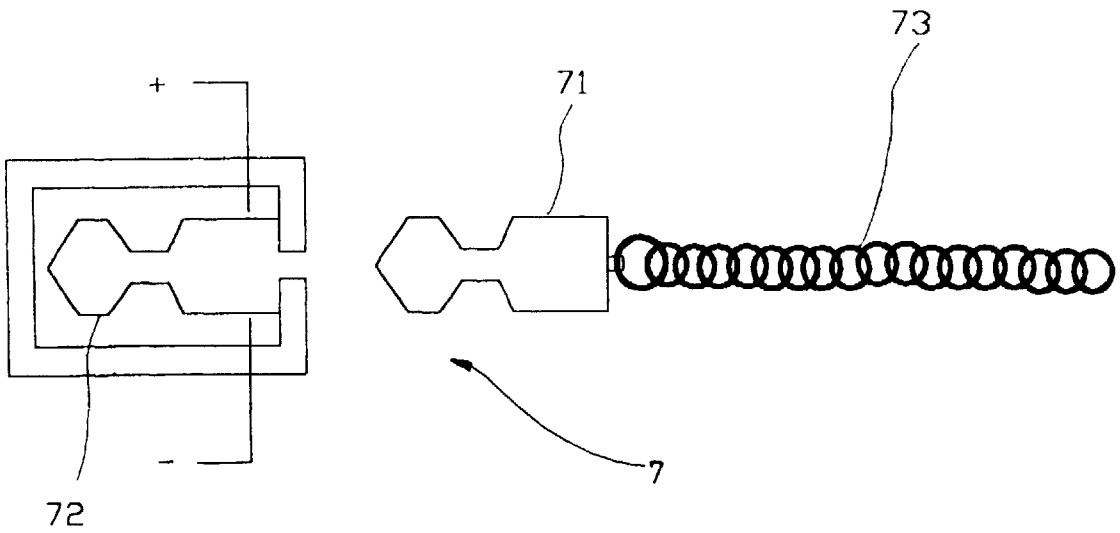
FIG. 2 is a structural view of the security pull pin of the present invention.
Figure 3:
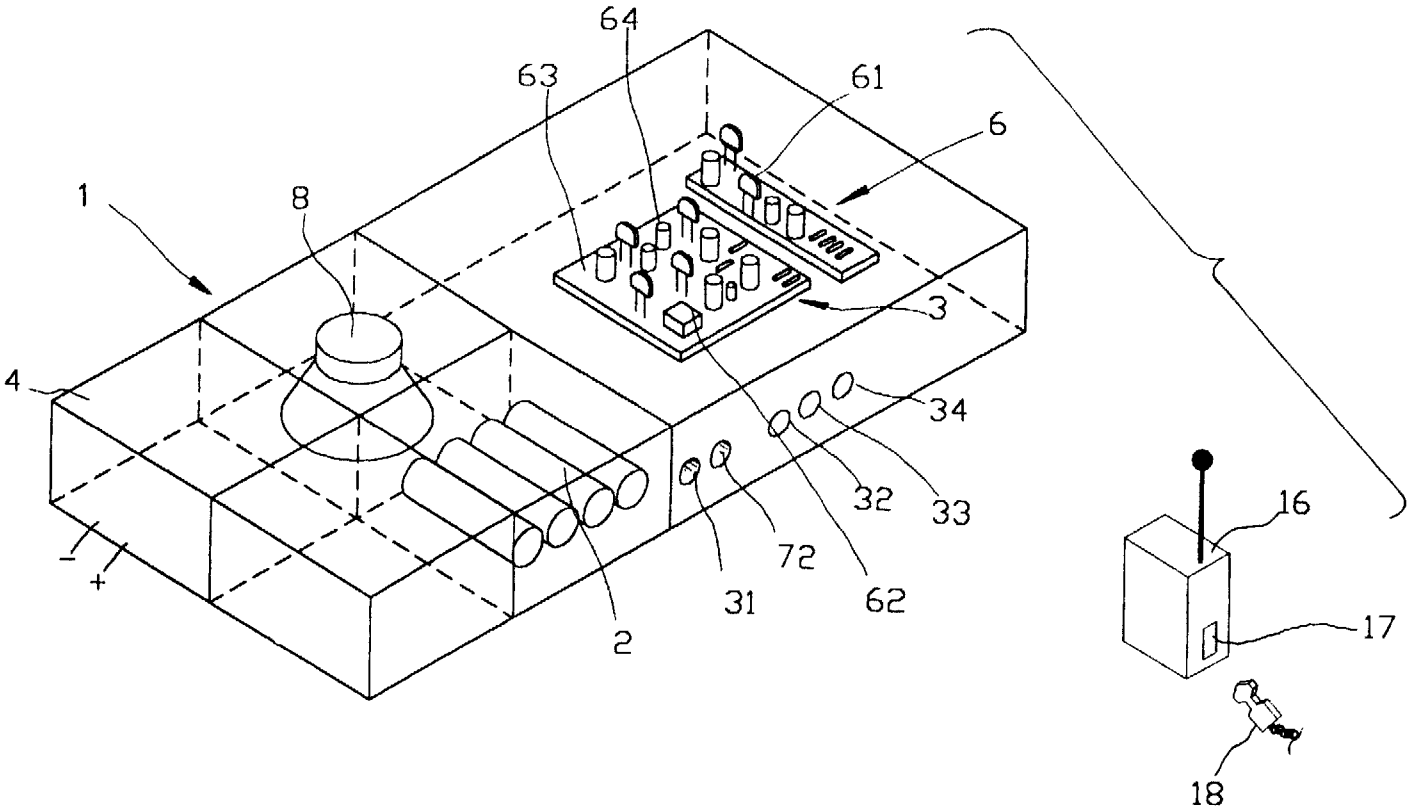
FIG. 3 is a structural view of the present invention.
Figure 4:
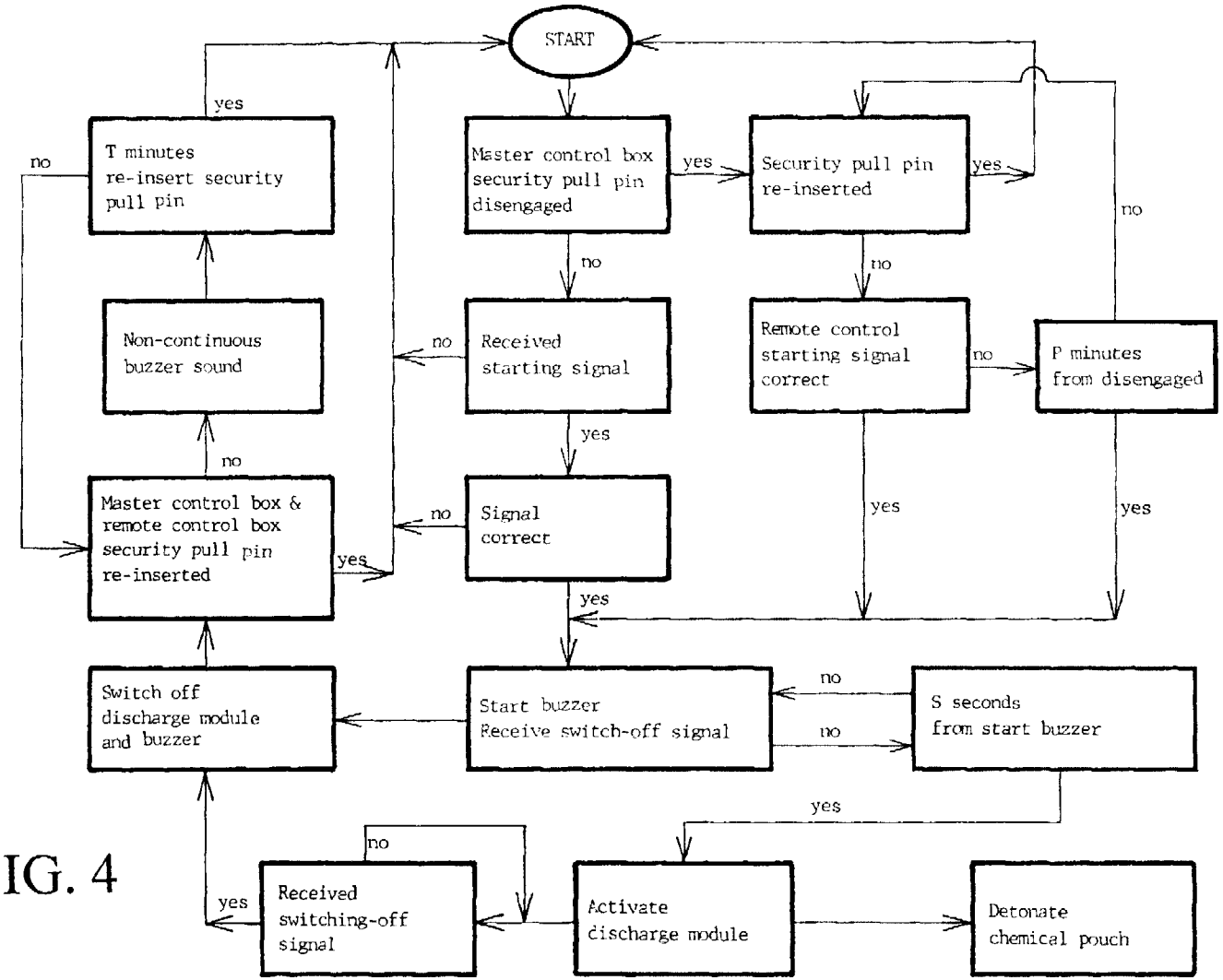
FIG. 4 is a flow chart of the present invention in operation.
Figure 5:
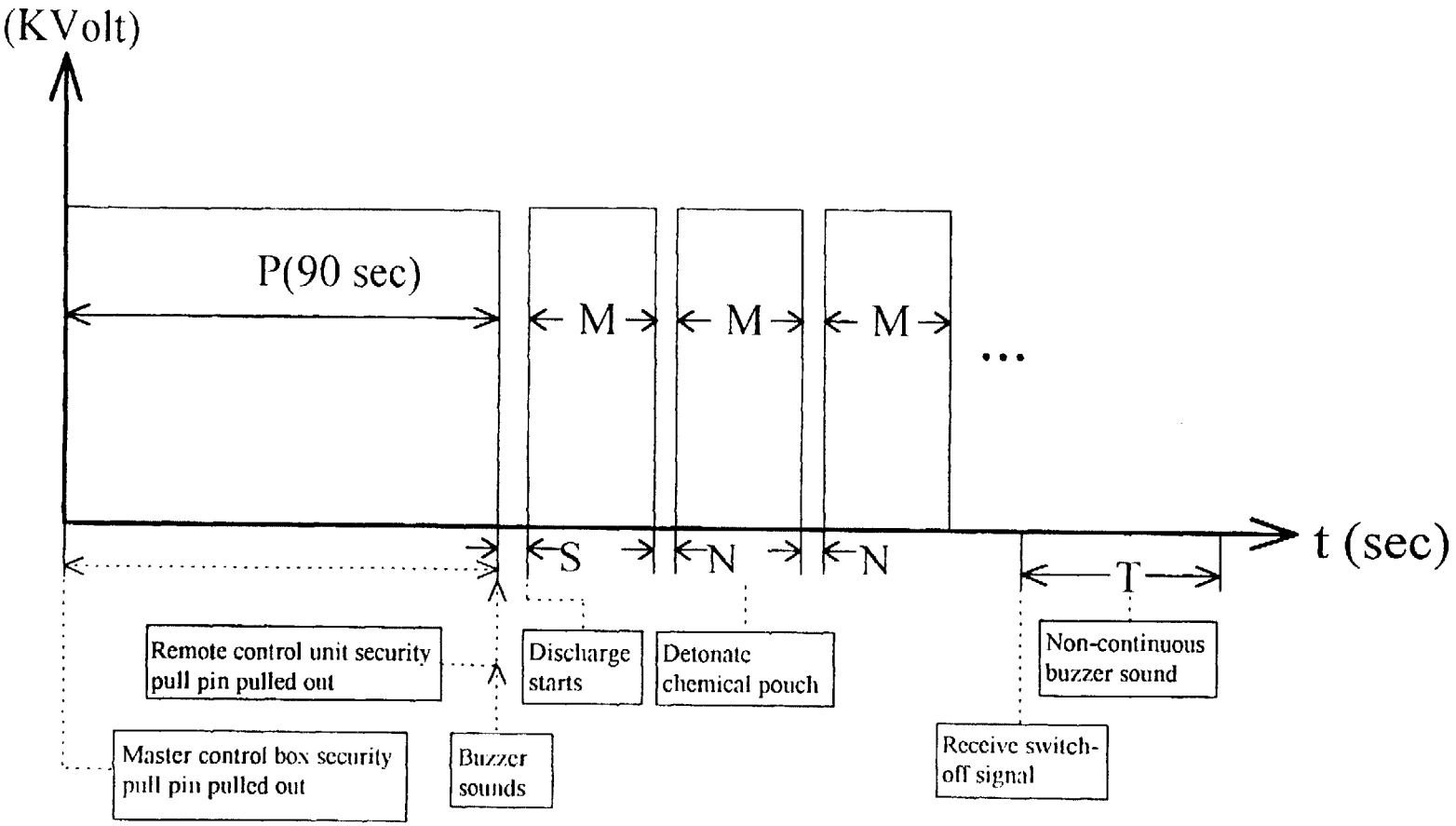
FIG. 5 is a chart of current delivery progress of the present invention.
Figure 6:
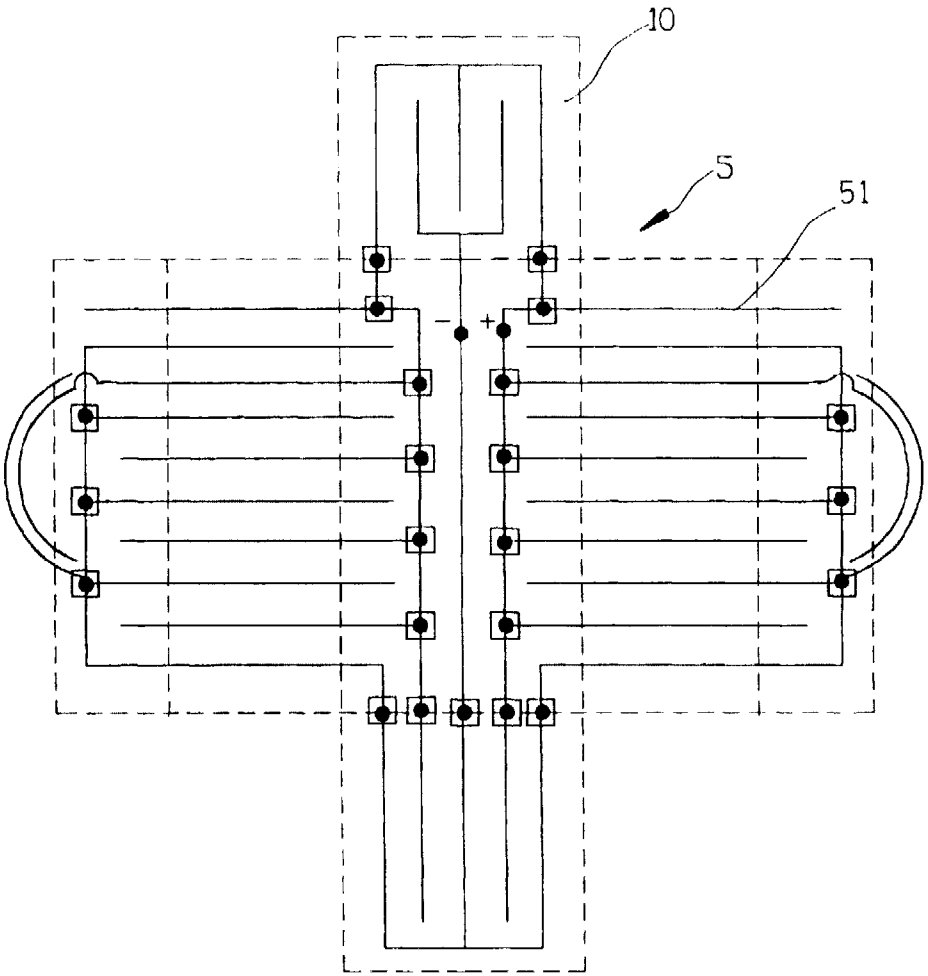
FIG. 6 is the first wiring diagram of the present invention.
Figure 7:
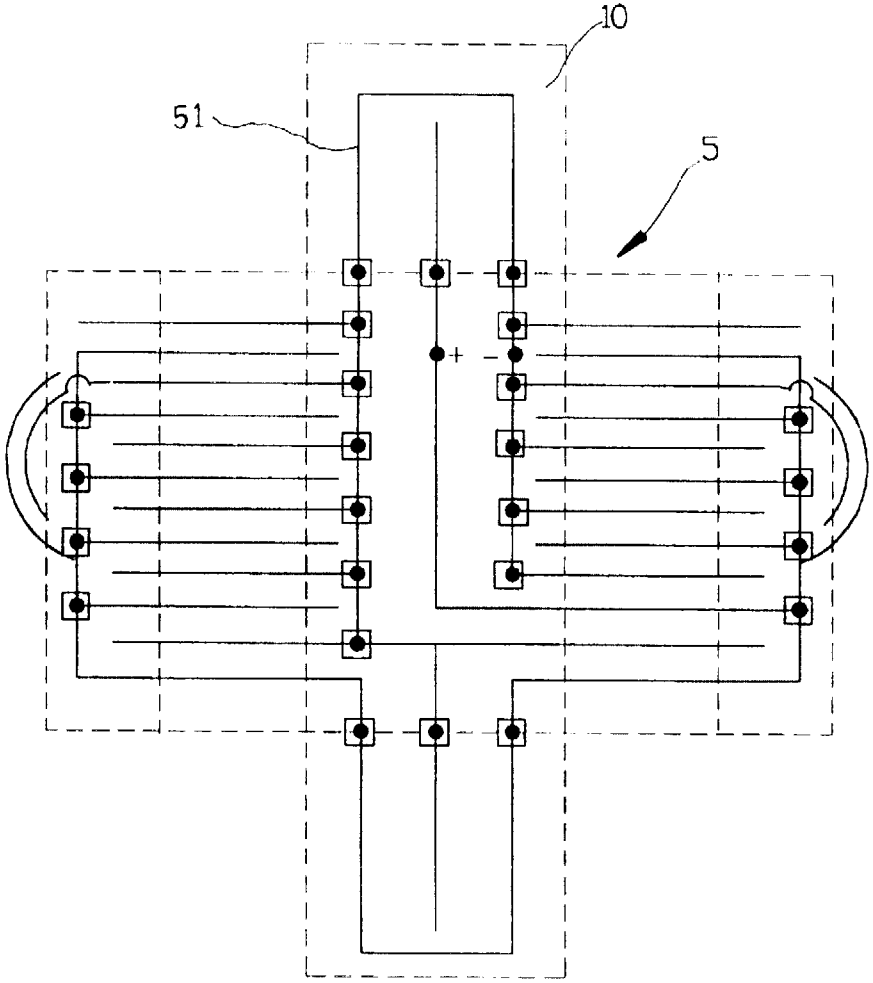
FIG. 7 is the second wiring diagram of the present invention.

Referring to FIGS. 1 to 7, the present invention is a continuation of a conventional conductive method in relation to the conduction of high voltage current, since the structure and theory of this part must be put to use in this way for the present invention. In other words, the present invention has a master control box 1. The master control box 1 comprises a charging battery set 2. The battery set 2 is charged by a rapid charging circuit 3. The charging circuit 3 can provide the charging function by connecting the power source connector 31 with an outside power source. There are several lights 32, 33, 34 to display the three modes of charging, working and lack of power. The power from the battery set 2 passes through a high voltage discharge unit 4 before it is connected with the wires 51 that are spaced around the interior of the handbag/box 10. These wires 51 are spaced between an interval of approximately 2.5 cm to 5 cm, to comprise a discharge module 5, as illustrated in FIGS. 6 and 7, which is a simple wiring method; unlike the prior art which involves perforated edges around a circuit board which are respectively connected with one end of the respective wires. In the present invention, we need only connect the positive and negative terminals of the discharge unit 4 with any point of the positive wire set and the negative wire set, and the positive wire set and the negative wire set encompass all the sides of the handbag/box; they are neatly arranged, so the production process is convenient; that is the difference between the present invention and the prior art. The naked wires 51 are adhered onto the interior of the handbag/box 10; on the handle of the handbag/box 10 are also embedded with the naked copper wires 51; such an arrangement is more convenient and easier than the prior art. Furthermore, the power source is connected to the central processing device 6. The central processing device 6 involves such the electronic components as the circuit board 61 and the central processing unit 62. Meanwhile, the central processing device 6 is further connected with a radio frequency signal receiver 63, a security pull pin 7, a high-volume buzzer 8, a chemical pouch 9, a timer 64, a discharge unit 4 and a charging circuit 3.

The above-mentioned components of the present invention are all installed in a master control box 1. A recommended location for the master control box 1 is at the bottom of the handbag/box 10, simply placed flat on the bottom, or it may be separated by a partition plate or a partition cloth 15, so as to avoid the inconvenience in a prior art that requires the complete removal of the entire device to charge the recharge batteries; then, on the side 13 of the handbag/box 10 is an opening 14. Through this opening 14, the plug 71 of the security pull pin 7 is inserted to the socket 72; the plug 71 is linked with a chain 73 to the waist belt of the person who is carrying the cash. By the connection between the plug 71 and the socket 72, the security pull pin 7 will control the function of the central processing device 6 in the master control box 1. In case the plug 71 is pulled out, the anti-robbery device will be automatically activated after a period of P minutes. Besides, the present invention is further provided with a remote control unit 16. The remote control unit 16 is carried by the cash carrier. On the remote control unit 16 is a socket 17 for an auxiliary security pull pin 19, and a plug 18 for the auxiliary security pull pin 19, so the plug 18 may be inserted in the socket 17. When the plug 18 of the remote control unit 16 is pulled out, the start signal generated by the remote control unit 16 will be transmitted to the receiver 63 in the master control box 1; in this case, it is in a direct starting mode, no matter if the security pull pin 7 in the master control box 1 is pulled or not. Moreover, the activation of the master control box 1 is in an indirect starting mode; it will determine whether the security pull pin 7 is pulled out; if it is pulled, it will determine within P minutes whether the signal from the remote control 16 is correct; if it is correct, it will activate the system immediately, or will wait for P minutes and then activate the system automatically, and allow the buzzer 8 to sound for a short time so that the discharge unit 4 will allow the discharge module 5 to release high voltage current, and detonate the chemical pouch 9; once it is discharged, the whole bag/box will release high voltage current to force the robber to drop the bag/box; since the master control box I does not have a power switch, the robber will not be able to turn off the high voltage discharge unit 4, which will last until the power is consumed. The buzzer 8 will then send out a high shrieking sound to attract people's attention or enable the security personnel to trace the source of alarm, and the chemical pouch 9 will emit colored smoke. The chemical pouch 9 provides three functions: (1) The money will be dyed, to enable easy and quick identification by the police when the robber tries to circulate the money; (2) The emission of smoke will force the robber to mistake it as burning fire and drop it immediately; so the loss can be avoided; (3) The emission of tear gas will hinder the robbers actions.

In the master control box 1 of the present invention, there is a central processing unit 62 that will allow the discharge unit 4 to discharge for a period of M seconds before a pause for N seconds, as illustrated in FIG. 5. The N value being preset at less than 1 second, so, with a very short interval to penetrate the high intensity electrical field, the switching-off signal from the remote control unit 16 will switch off the power of the master control box 1 after it was activated. The remote control unit 16 activates the master control box 1 only upon that the auxiliary security pull pin 19 is pulled out. The anti-robbery handbag/box of the present invention can be safely carried because the master control box 1 is under the switched-off condition as a result from that the plug 71 of the security pull pin 7 is inserted in the socket 72 of the master control box 1; when the plug 71 is pulled out, the microprocessor will activate the burglar-proof function. Also, the auxiliary security pull pin 19 of the remote control unit 16 may be inserted or the stop key of the remote control unit 16 can be depressed to discontinue the alarm function, based on the same theory. In the master control box 1 of the present invention, there is a timer 64 to preset the desired timing; when the security pull pin 7 of the master control box 1 is pulled out, the timer 64 will not activate the anti-robbery device until after a period of P minutes; so designed to allow the robber to run away for a distance, so the safety of the victim can be assured; it is normally preset at 0.5 to 3 minutes as a delay function, so the robber will carry away the present invention with him into his car, thinking that he has successfully run away with the money; until the preset time has elapsed, the alarm will be activated automatically; or, an alternative operation is to directly activate the alarm with the remote control unit after the user has made sure of his personal safety, by pulling the security pull pin out of the master control box or pulling the auxiliary security pull pin out of the remote control unit, or by disengaging both the two connections, the device will automatically activate the discharge module and detonate the chemical pouch, to discourage the robber and make him drop the present invention of the anti-robbery bag/box. After the present invention is activated, there will be a period of only the buzzer sounding for 1 to 3 seconds; so designed that in case another remote control unit has mis-activated the unit with a same frequency and same code or mis-pull of safety pins, the person carrying the cash may be able to reset the function or drop the present invention. The present invention will be switched off after the robber is arrested, or after the present invention is recovered, or after the robber has discarded the present invention. In this case, the master control box receives the switching-off signal, so the buzzer will sound intermittently until the cash carrier has re-inserted the security pull pin in the master control box and re-inserted the auxiliary security pull pin in the remote control unit; it is so designed to ensure that the unit has recovered to initial condition.

Therefore, there are two starting modes for the present invention: (1) Disengage the pull pin (or a fastener) from the master control box to activate the alarm after a period of P minutes; (2) Start with the remote control unit; which is an improvement on the first weakness in a prior art. Meanwhile, the auxiliary security pull pin or a similar fastener structure is used to improve on the second weakness in a prior art which involves touching off the remote control key by mistake; since the security pull pin is not pulled out, the unit could not be activated. After the master control box is activated, the buzzer will send out alarm, then wait for S seconds before it produces the electric shock function, to allow the cash carrier sufficient time for response; so designed to solve the third weakness of a prior art, so that foreign signals will not interfere the performance of the present invention. The function of the chemical pouch will solve the fourth weakness. The intermittent discharge of current will solve the fifth weakness in a prior art.

As described above, the main function of the present invention lies in that: with the use of the discharge module to discharge high voltage current, the high-volume buzzer to send out alarm, the chemical pouch to dye the paper money and emit a smoke to make the impression of a fire burning, and the discharge module that may be interrupted to reduce accidental activation; the whole mechanism has more advanced functions than a prior art; besides, it will be able to prevent a robbery and protect the safety of the money carrier. The whole structure has its applicability, and is more easily assembled and put to use than a prior art.

It is hereby declared that the above description, covering the preferred embodiment, should not be based to limit or restrict the claims herein, and that all equivalent structural and/or configurational variations and/or modifications that are easily conceivable by anyone skilled in the prior art, should reasonably be included in the intent of the claims of the present invention.

I claim:

1. An anti-robbery handbag or container, comprising:

a bag or container body, a master control box located inside said bag or container;

a discharge module, with spaced wires, the wires being evenly distributed in an interior lining and a handle of the bag or container;

a high voltage discharge unit, with voltage boosting function to boost to a high voltage, and connected with the wires of the discharge module; being located inside the master control box;

a battery set, comprising a number of recharging battery cells; being connected with the high voltage discharge unit; located inside the master control box;

a buzzer, with a high sound volume; located inside the master control box;

a remote control unit, with DC power source to send out signals; being an independent device equipped with a power "ON" safety pin and "OFF" switch;

characterized in that the device further comprises:

a security pull pin, with a first socket in the master control box, with a first plug that is linked with a chain to an appropriate location; wherein in its normal mode, said first plug is inserted in said first socket, so the power source of the battery set is not conducted; and when said first plug is pulled out, a timer provides a delay period before a buzzer sounds for a short time, then, an electric current will be conducted to activate said high voltage discharge unit; so said discharge module sequentially arranged in cross intervals will discharge high voltage current;

said remote control unit also comprising an auxiliary security pull pin, to turn on the power source, a second socket on said remote control unit, and a second plug, so said second plug may be inserted in said second socket on said remote control unit, so designed that said remote control unit will activate the buzzer in the master control box to send out buzzing sounds and discharge high voltage current;

a fast charging circuit, connected with the battery set and located in the master control box, which may be connected with an outside power source to charge the battery set;

a radio frequency signal receiver, to receive the signals from said remote control unit;

a chemical pouch, containing chemicals in said pouch; located inside the master control box;

a central processing device, comprising a circuit board, respectively connected with said battery set, said discharge unit, said buzzer, said chemical pouch, said radio frequency signal receiver, said security pull pin, said charging circuit and said timer; so, when said security pin in said master control box starts the activation, it will discharge high voltage current on said bag or container body, an said buzzer will sound, and said chemical pouch will spray smoke on any monetary notes in said bag or container; and on said circuit board which is mounted on a central processing unit that executes all control actions, and enables said discharge unit to repeat a longer charging period and a minimum interrupted power period in a circulation, so that the switching-off signal from said remote control unit may penetrate the interval of current interruption to switch off the action of said master control box.

* * * * *